United States Patent [19]

Kuhn

[11] 3,934,364

[45] Jan. 27, 1976

[54] DISPLAY DEVICE FOR VARYING THE SHAPE AND CROSS-SECTION OF A RECTANGULAR AREA

[75] Inventor: Hans-Robert Kühn, Kiel, Germany

[73] Assignee: Electroacustic GmbH, Kiel, Germany

[22] Filed: Nov. 12, 1973

[21] Appl. No.: 415,020

[30] Foreign Application Priority Data

Nov. 15, 1972 Germany ..... 2255904

[52] U.S. Cl. ..... 40/28 R

[51] Int. Cl.[2] ..... G09F 11/00

[58] Field of Search ..... 40/1, 28, 61

[56] References Cited

UNITED STATES PATENTS

| | | | |
|---|---|---|---|
| 1,813,689 | 7/1931 | Weisker | 355/74 |
| 1,882,293 | 10/1932 | Mueller | 355/74 |
| 2,245,527 | 6/1941 | Grabfield | 355/75 |

*Primary Examiner*—Melvin D. Rein
*Assistant Examiner*—Wenceslao J. Contreras
*Attorney, Agent, or Firm*—Herbert L. Lerner

[57] ABSTRACT

A display device having a rectangular area of variable shape and cross-section with a pair of movable line markers defining the horizontal boundaries and another pair of movable line markers defining the vertical boundaries, means for moving each pair of line markers to vary the distance therebetween to obtain the rectangular area of desired shape and cross-section. Simultaneous movement and regulated separation of pairs of line markers may be obtained by rotating elliptical cams connected to the line markers.

3 Claims, 1 Drawing Figure

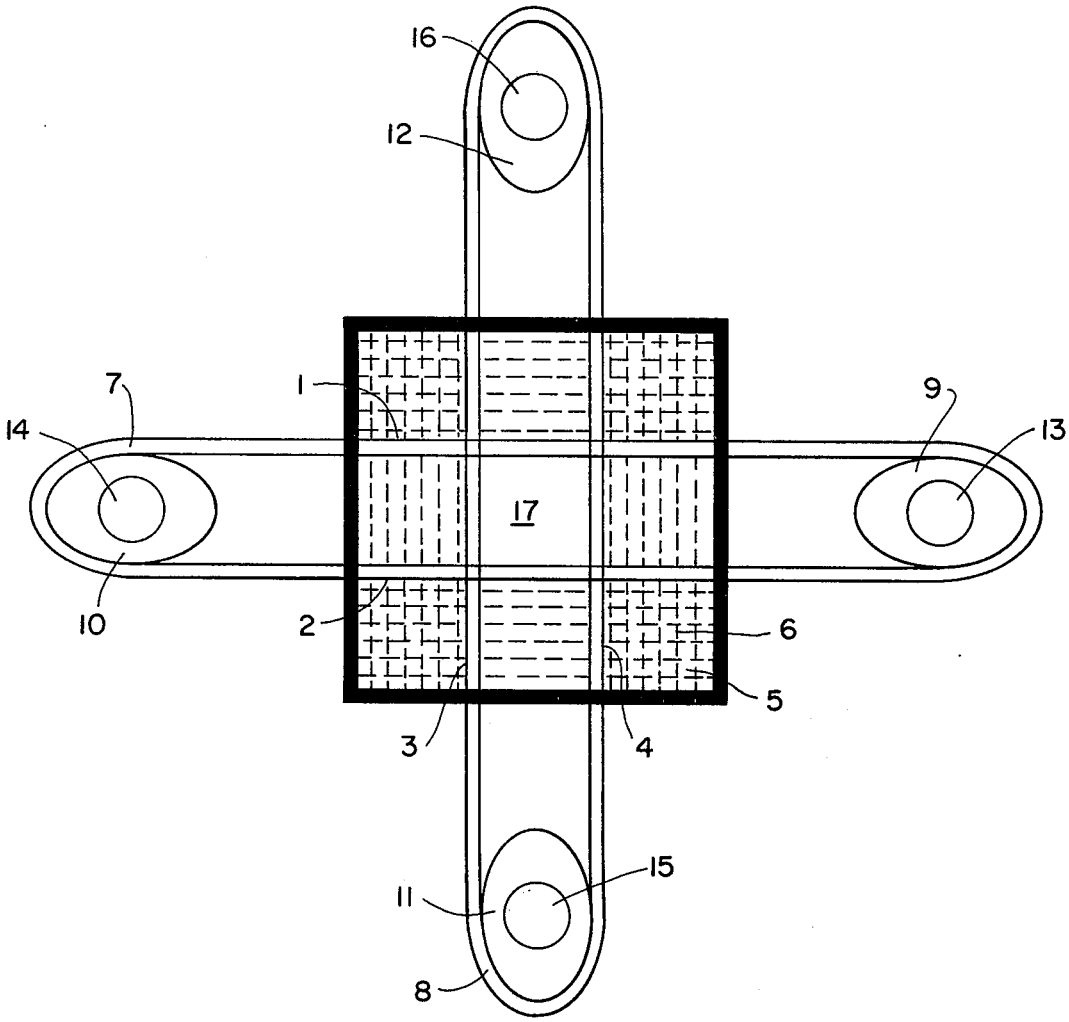
16
12
7
1
9
14
13
17
10
2
6
5
3
4
15
11
8

DISPLAY DEVICE FOR VARYING THE SHAPE AND CROSS-SECTION OF A RECTANGULAR AREA

This invention relates to means for varying the distance between two pairs of spaced opposed line markers at right angles to one another and more particularly refers to the display device having rectangular surface which can be varied in shape and cross-sectional area.

Display devices having an illuminated display surface of fixed dimension and area are known. Unfortunately such display devices are not readily adapted for change in shape and size of area to accommodate different displays.

With the foregoing and other objects in view, there is provided, in accordance with the invention, a display device having a centrally disposed rectangular area of variable shape and cross section, a pair of movable line markers or shutters defining the upper and lower horizontal boundaries of said rectangular area, another pair of movable line markers or shutters defining the right and left vertical boundaries of said rectangular area, means for concurrently moving said pair of horizontal shutters to vary the vertical distance between said horizontal shutters, means for concurrently moving said pair of vertical shutters to vary the horizontal distance between said shutters whereby the rectangular area of desired shape and cross section is attained.

In a preferred embodiment the means for concurrently moving said pair of horizontal shutters are two rotatable elliptical cams placed horizontally opposite each other whereby rotation of said cams induces variation in vertical distance between said horizontal shutters, and said means for concurrently moving said pair of vertical shutters are two rotatable elliptical cams placed vertically opposite each other whereby rotation of said cams induces variation in horizontal distance between said vertical shutters. The elliptical cams may be connected to the shutters by elastic tables stretched over the elliptical cams.

In accordance with the present invention varying the distance between a first spaced pair of objects opposite each other and between a second spaced pair of objects opposite each other, the second pair of objects being disposed at a right angle to the first pair of objects, that is for moving each object toward and away from its opposite object, is accomplished by rotating elliptical cams coupled to the means for moving the objects thereby effecting simultaneous movement and regulated separation of the objects in each pair. The four objects may be shutters in a display device. The method is also applicable to apparent movement of loud speakers arranged in opposing pairs at right angles to one another.

Other features which are considered as characteristic for the invention are set forth in the appended claims.

Although the invention is illustrated and described herein as embodied in an illuminated display device and method for displaying the acoustical properties in stero reproduction, it is nevertheless not intended to be limited to the details shown, since various modifications and structural changes may be made therein without departing from the spirit of the invention and within the scope and range of equivalence of the claims.

The construction and method of operation of the invention, however, together with additional objects and advantages thereof will be best understood from the following description of specific embodiments when read in connection with the accompanying drawing.

Referring to the drawing illustrating an illuminated display device, area 5 bounded by the heavy black lines consists of an illuminated display surface fabricated from a material pervious to light i.e. a transparent or translucent material. Display surface 5 is provided with marks 6 so that the indicated dimensions of area 17 can be read accurately. Arranged directly behind the illuminated display surface 5 are two adjustable line markers or shutters designated 1 and 2 to represent the vertical dimension of area 17 and two adjustable line markers or shutters 3 and 4 intercepting line markers 1 and 2 to represent the horizontal dimension of area 17. Line markers 1, 2, 3 and 4 may be the terminal ends or attached to moveable shutters desirably fabricated of an opaque material. These shutters may be attached at the end opposite the markers to a roller on which the shutter is wound.

As the line markers come closer together the shutters will extend downwardly covering a greater area and conversely as the distance between line markers expands the shutters will rise thereby exposing a greater rectangular area 17. Although a shutter wound on a roller may be employed, various types of movable shutters may also be used.

The line markers 1 and 2 and the line markers 3 and 4 may each be formed by an endless elastic cable 7 and 8, respectively. Cable 7 is stretched over elliptical cams 9 and 10, which are disposed along side display surface 5 and are located horizontally opposite each other. Similarly cable 8 is stretched over elliptical cams 11 and 12 which are vertically opposite each other. Elliptical cams 9, 10, 11 and 12 are each mounted on a rotatable shaft 13, 14, 15 and 16. Thus when elliptical cams 9, 10, 11 and 12 are rotated, the line markers 1, 2, 3 and 4 are brought together or apart and the shape and size of the area 17 is thereby changed. Area 17 reaches a maximum determined by the length of the long axis of elliptical cams 9, 10, 11 and 12 and a minimum area determined by the small axis of the elliptical cams. Of course intermediate areas may be obtained by partial rotation of the elliptical cams. Similarly it will be evident that the shape of the rectangle 17 may be varied by the degree of rotation of the cams. Instead of elastic cables 7, 8, movable supported shutters can also be controlled by the elliptical cams 9, 10, 11 and 12.

A typical use of the display is as follows.

In equipment for stereo reproduction it is known to electronically vary the apparent size of the baseline between the two loudspeakers by means of a suitable control element. This is accomplished by in-phase or opposed phase cross-feeding of a larger or lesser portion of the signal amplitude of one channel into the other channel. Opposed crosstalk results in increased extension of the bases. However, it must be stressed that the resulting change of the base line is virtual only, i.e., one has the acoustic impression as if the loudspeakers had moved further apart or respectively closer together. In reality, however, they remain in their positions.

In quadrophonic installations, this virtual change of the base lines can be made as well in the right and left loudspeakers as in the front and rear speakers. The resulting virtural area is then either larger or respectively smaller as the rectangle which is formed by the loudspeaker.

The present invention displays this virtual area so it can be seen.

Referring to the drawing, there are shown by line markers 1, 2, 3 and 4. The line markers may be said to define a rectangular area 17. As previously mentioned each of the line markers are attached to movable control elements to permit this movement away from one another or toward one another. The control elements which serve to vary the apparent size of the base lines between the four loudspeakers may be connected with shafts 13, 14, 15 and 16. By rotating the shafts 13, 14, 15 and 16, the control elements with the elliptical cams 9, 10, 11 and 12 are operated at the same time, thereby displaying the apparent size of the base area between the four loudspeakers.

I claim:

1. A display device having a centrally disposed rectangular area of variable shape and cross-section, a pair of movable line markers defining the upper and lower horizontal boundaries of said rectangular area, another pair of movable line markers defining the right and left vertical boundaries of said rectangular area, means for concurrently moving said pair of horizontal line markers to vary the vertical distance between said horizontal line markers, means for concurrently moving said pair of vertical line markers to vary the horizontal distance between said vertical line markers whereby the rectangular area of desired shape and cross-section is attained, said line markers comprising endless stretchable belts said means for concurrently moving said pair of horizontal line markers comprising two rotatable elliptical cams placed horizontally opposite each other said horizontal line marker belts being mounted on said horizontally displaced cams whereby rotation of said horizontally displaced cams induces variation in vertical distance between said horizontal line markers, and said means for moving said pair of vertical line marker belts comprising two rotatable elliptical cams placed vertically opposite each other said vertical line marker belts being mounted on said vertically displaced cams whereby rotation of said vertically displacing cams induces variation in horizontal distance between said vertical line markers.

2. A display device as in claim 1 wherein said horizontally placed elliptical cams are connected to said horizontal shutters by elastic cables stretched over said elliptical cams and said vertically placed elliptical cams are connected to said vertical shutters by elastic cables stretched over said elliptical cams.

3. A display device as in claim 1 wherein said rectangular area is illuminated and pervious to light and wherein said line markers are arranged directly behind said rectangular area.

* * * * *